United States Patent [19]

Mayer

[11] Patent Number: 4,821,915

[45] Date of Patent: Apr. 18, 1989

[54] TWIN WALL FIBERGLASS TANK AND METHOD OF PRODUCING THE SAME

[75] Inventor: John M. Mayer, Strongsville, Ohio

[73] Assignee: Corespan, Inc., Geneva, Ohio

[21] Appl. No.: 23,475

[22] Filed: Mar. 9, 1987

[51] Int. Cl.[4] ..... B65D 25/18

[52] U.S. Cl. ..... 220/441; 220/445; 220/5 A

[58] Field of Search ..... 220/441, 438, 440, 445, 220/5 A

[56] References Cited

U.S. PATENT DOCUMENTS

| | | | |
|---|---|---|---|
| 2,477,852 | 8/1949 | Bacon . | |
| 2,501,180 | 3/1950 | Kunz . | |
| 2,644,777 | 7/1953 | Havens . | |
| 2,668,327 | 2/1954 | Steele . | |
| 2,742,387 | 4/1956 | Giuliani . | |
| 2,769,481 | 11/1956 | Meanor et al. . | |
| 3,066,822 | 12/1962 | Watter | 220/441 X |
| 3,169,898 | 2/1965 | Kazimi . | |
| 3,209,290 | 9/1965 | Grande | 220/441 X |
| 3,258,854 | 7/1966 | Ascoli et al. . | |
| 3,295,327 | 1/1967 | Waterman | 220/445 X |
| 3,617,416 | 11/1971 | Kromrey . | |
| 3,949,056 | 5/1976 | Caplan . | |
| 4,561,292 | 12/1985 | Pugnale et al. | 220/441 X |
| 4,651,893 | 3/1987 | Mooney | 220/445 |
| 4,655,367 | 4/1987 | Palazzo | 220/445 |

*Primary Examiner*—Steven M. Pollard

*Attorney, Agent, or Firm*—Renner, Otto, Boisselle & Sklar

[57] ABSTRACT

A twin wall fiberglass tank and method of producing the same has an inner wall, an outer wall, and a core disposed between the inner and outer walls which forms a plurality of air gaps. Each of the inner and outer walls is formed of one or multiple layers of woven fiberglass roving and a mixture of resin and chopped fiberglass. The core includes a plurality of sinusoidal shape collated fiberglass flutes bonded to fiberglass scrim. The structure and configuration of the core allows it to be bent about an axis transverse to the collated flutes such as the curved surface formed by the inner wall of a twin wall tank. More particularly, after the inner wall of the twin wall tank has been formed, and prior to the outermost layer of the inner wall having cured, the core is wrapped about the inner wall in a barber pole fashion with the scrim forming the outermost surface. Immediately thereafter, the outer wall may be formed utilizing the scrim as a base. In addition to producing storage tanks, the present invention may also be utilized to produce any one of a variety of fiberglass structures having a curved surface including, for example, domes, arches, above-ground tank walls, or the like.

22 Claims, 4 Drawing Sheets

TWIN WALL FIBERGLASS TANK AND METHOD OF PRODUCING THE SAME

DISCLOSURE

This invention relates to structures having curved surfaces and to methods for making same, and, particularly, to such structures that are at least in part made of fiberglass or like material. More particularly, this invention relates to twin wall fiberglass tanks having an inner wall, an outer wall, and a core disposed between the inner and outer walls.

BACKGROUND

Various states, localities, and government agencies have adopted laws and regulations which require the use of twin wall tanks for storing fuels, chemicals, materials, gases, or the like. Such twin wall tanks must include air gaps or spaces between the inner and outer walls of the tank. These air gaps are provided with sensors which detect the flow or seepage of materials through either the outer or the inner wall of the tank. The detection of seepage signals the presence of a structural failure in either the inner or outer wall. Upon detection, the contents of the tank may be immediately removed and the tank replaced thus minimizing the possibility of contaminating the environment in the proximity of the tank with the contents thereof.

The prior art provides various twin wall tanks. Such prior art tanks are generally produced from either fiberglass or steel. Unfortunately, such prior art tanks present various disadvantages and drawbacks. Specifically, twin wall steel tanks are expensive to fabricate and are quite heavy. Steel tanks are also susceptible to the ravages of corrosion if appropriate corrosion prevention systems are not employed. Prior art twin wall fiberglass tanks are also quite expensive to fabricate. Such fiberglass tanks require a considerable number of man hours to produce for the inner wall must be fully cured and prepared before the outer wall may be formed. The preparation entails mechanically abrading or sanding the outer surface of the inner wall after a complete cure to ensure an adequate bond between the outer and the inner walls. These cure and preparation requirements are costly because they require additional man hours and they tie up expensive capital equipment.

The present invention provides a twin wall fiberglass tank and method of making the same which overcomes the disadvantages and drawbacks associated with prior art twin wall tanks.

SUMMARY OF THE INVENTION

According to the present invention, an improved twin wall fiberglass tank has various distinct advantages over prior art twin wall tanks. For example, a twin wall fiberglass tank made in accordance with the present invention is lighter weight, stronger, and more durable than comparable size and/or weight prior art fiberglass tanks. Additionally, the present invention provides a unique method for producing twin wall fiberglass tanks. This unique method results in considerably shorter production times with lower associated costs for it allows for the continuous production of a twin wall tank. Unlike prior art methods, no time is lost waiting for the inner wall to cure before the outer wall is formed. Additionally, the present method does not require the mechanical abrading of the inner wall to ensure an adequate bond.

A twin wall fiberglass tank made in accordance with the present invention includes an inner wall, an outer wall, and a core disposed between the inner and outer walls which forms a plurality of air gaps. The inner and outer walls may be formed of multiple layers of woven fiberglass roving and a mixture of resin and chopped fiberglass. The core is produced separate and apart from the inner and outer walls of the tank and it may be formed of a plurality of flutes, preferably sinusoidal shape collated fiberglass flutes, bonded along one lateral edge to a length of scrim also preferably of fiberglass. The structure and configuration of the core allows it to flex and to bend about an axis transverse to the collated flutes such as the curved surface of the inner wall of the tank. This flexibility facilitates the continuous construction of a twin wall fiberglass tank. The structure and configuration of the core also provides a stronger and more durable tank when compared to a prior art twin wall fiberglass tank of equal weight.

An advantage of the present invention is that before the outermost layer of the inner wall has cured, the core may be wrapped in a barber pole or helical fashion tightly around the inner wall thus permitting the scrim to form the outermost surface or part thereof while one lateral edge of the flutes abuts the inner wall. This method of construction leads to a secure bond between the core and the inner wall. The outer wall may be constructed upon the scrim of the core immediately thereafter. It is not necessary to wait for the inner wall to cure or mechanically to abrade the inner wall (since it is still not fully cured) before commencing with the construction of the outer wall.

In addition to tanks, the present invention may be readily used for other twin wall fiberglass structures, especially those having a curved surface. Such fiberglass structures may include, for example, domes, arches, above-ground tank walls, or the like.

The foregoing and other features of the invention are hereinafter more fully described and particularly pointed out in the claims, the following description and the annexed drawings setting forth in detail certain illustrative embodiments of the invention, these being indicative, however, of but a few of the various ways in which the principles of the present invention may be employed.

DETAILED DESCRIPTION OF THE PREFERRED EMBODIMENT

Figure 1:
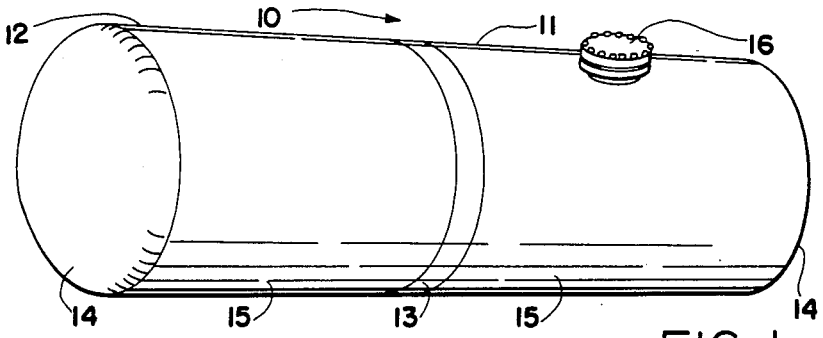
FIG. 1 is a perspective view of a twin wall tank made in accordance with the present invention.
Figure 2:
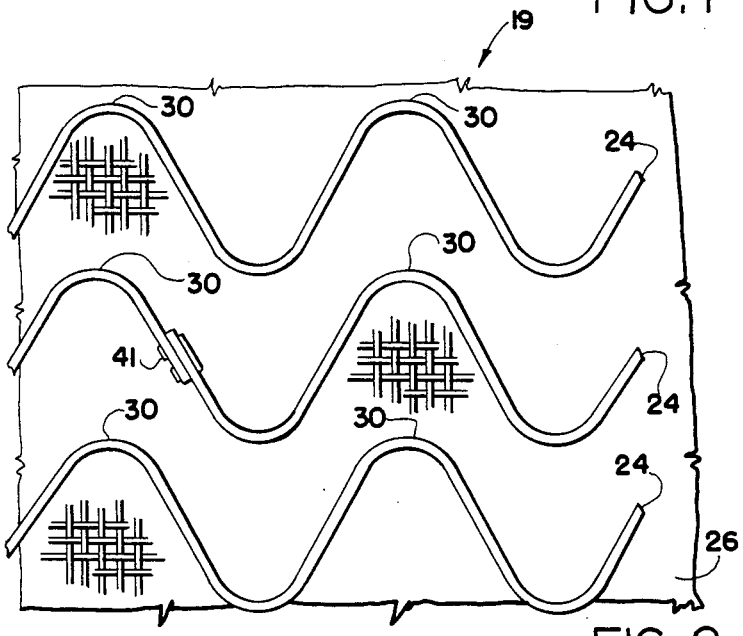
FIG. 2 is a fragmentary top plan view of the core material utilized in the production of the tank illustrated in FIG. 1.

Referring to FIG. 1 there is illustrated a fiberglass twin wall tank 10 for storing a variety of materials made in accordance with the present invention. Tank 10 provides many distinct advantages over prior art twin wall tanks, e.g., as is mentioned elsewhere herein. The invention further provides a unique method for producing tank 10, especially on a continuous basis with attendant advantages.

Tank 10 may be employed to store a variety of materials including solids, liquids, and gases. For example, tank 10 may be utilized to store fuels such as gasoline, kerosene, and industrial chemicals such as sulfuric and hydrochloric acid. Additionally, tank 10 may be adapted for use both above and below ground.

Tank 10 preferably is formed of a pair of tank halves 11 and 12 connected at their open ends with joint 13. Tank halves 11 and 12 each include end walls 14 and side walls 15. Tank half 11 further includes a resealable access opening 16 which extends through side wall 15. Except for the access opening 16, tank halves 11 and 12 are essentially mirror images of one another.

Figure 3:
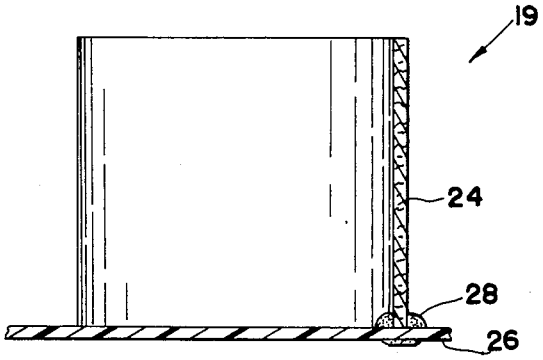
FIG. 3 is a fragmentary cross-sectional view of the core material of FIG. 2.
Figure 4:
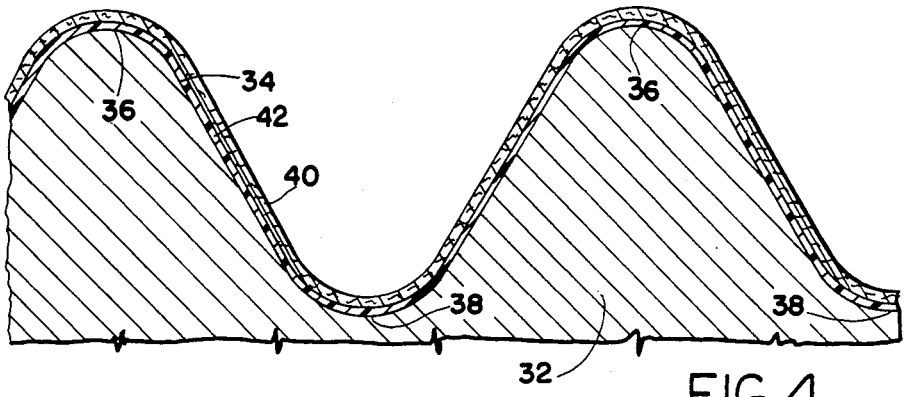
FIG. 4 is a fragmentary cross-sectional view of the mold and materials utilized to produce the core material of FIG. 2.
Figure 5:
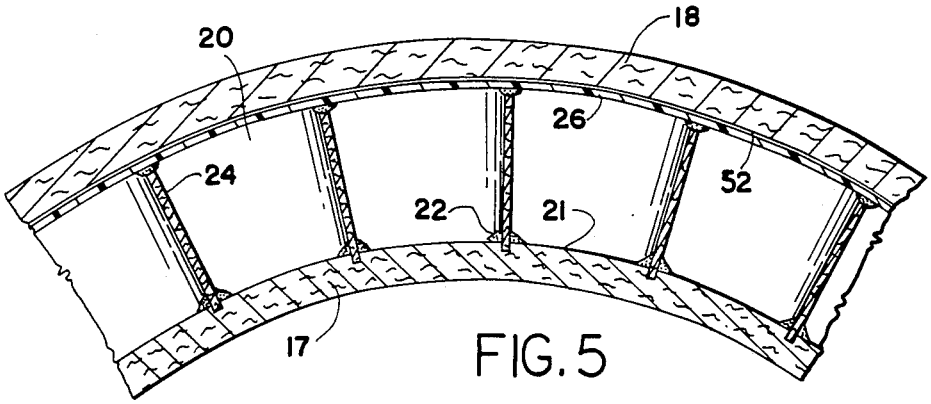
FIG. 5 is a fragmentary cross-sectional view of the side wall of the tank of FIG. 1.

Referring now to FIGS. 2–5, and initially to FIG. 5, side walls 15 include an inner wall 17, an outer wall 18, and a core 19 disposed between walls 17 and 18.

Core 19 reinforces the walls 17 and 18 and structurally strengthens the tank 10. Additionally, core 19 provides a plurality of air gaps 20 between the walls 17 and 18. Air gaps 20 permit the installation of leak detectors between the walls 17 and 18. Thus, in the event the inner wall 17 should break or rupture creating a leak in the inner wall 17, such leak detectors will sense the escape of fluids or gases contained within the confines of the inner wall 17. Similarly, in underground applications wherein the tank 10 is exposed to, for example, ground water, if the outer wall 18 develops a break or rupture, such leak detectors will sense the influx of water through the outer wall 18. Upon sensing a leak, tank 10 may be emptied of its contents and removed and replaced thus minimizing the possibility of any subsequent contamination of the environment in the proximity of the tank 10.

Core 19 is produced separate and apart from the walls 17 and 18 of the tank 10. Although core 19 is prefabricated, it displays sufficient flexibility to permit it to be bent over the outer curved surface 21 of the inner wall 17. This flexibility allows tank 10 and other structures having a curved surface to be constructed on a continuous basis. Such flexibility does not detract from the strength and integrity of the completed tank 10. In fact, the structure and configuration of the core 19 provides exceptional compressive strength along a direction perpendicular to the outer curved surface 21.

Core 19 includes a multitude of sinusoidal collated fiberglass flutes 24 bonded to a woven fiberglass scrim 26 by a bead of thickened resin 28. The flutes 24 are arranged in parallel such that the protruding portions 30 of each flute 24 align with one another. The flutes 24 are preferably about 3/64 of an inch thick and about one inch wide. Preferably, each flute 24 is spaced approximately two inches from the next flute 24. The scrim 26 is preferably a light weight glass fabric produced in compliance with specification ASTM D-1668-80. A scrim 26 suitable for use in the present invention is a glass fabric sold by Perma Glas-Mesh Corporation of Dover, Ohio under the designation Glass Fabric-Type 206. Preferably, the scrim 26 is about nine inches wide and it supports four flutes 24. It will be appreciated however, that scrim 26 may be of any width and it may support any number of flutes 24. Also, flutes 24 may be spaced at various distances.

Referring to FIG. 4 there is illustrated a mold 32 suitable for use in producing the flutes 24. Mold 32 may be constructed utilizing any one of a variety of materials including metal, wood, plastic, and the like. The top surface 34 of mold 32 forms a sinusoidal pattern to which the flutes 24 conform. The sinusoidal pattern is preferably such that there is approximately a four-inch horizontal distance from one peak 36 to the next. Additionally, preferably the vertical distance from each peak 36 to each depression 38 is about two inches. Also, to facilitate production of the flutes 24, top surface 34 is preferably quite large, for example, at least about twenty-five inches wide and at least about twenty feet long.

The flutes 24 are produced by first placing a length of 1-½ ounce fiberglass mat upon a sheet of mylar and rolling or distributing resin upon the mat. Subsequent to rolling or distributing the resin upon the mat, the mat preferably comprises about 30 percent by weight fiberglass and about 70 percent by weight resin. An example of a resin suitable for use in soaking the mat is a resin sold under the trademark ATLAC 400 by Koppers Company Inc., Pittsburgh, Penn.

After the fiberglass mat has been soaked and impregnated with the resin the impregnated mat 40 and mylar sheet 42 or other like release material are picked up and placed upon the top surface 34 of mold 32 such that the mylar 42 and impregnated mat 40 conform to the sinusoidal pattern formed by the top surface 34. The impregnated mat 40 and mylar 42 are left in position upon the top surface 34 until the resin hardens. After hardening of the resin, the impregnated mat 40 is stripped from the top surface 34 and the mylar 42. The impregnated mat 40 is then fed through a multi-blade saw to produce multiple flutes 24 having a width of about one inch.

It will be appreciated that the foregoing steps, dimensions and materials are exemplary according to the presently preferred embodiment and that equivalent or other steps, dimensions and/or materials may be used within the spirit and scope of the invention.

Various methods may be utilized to attach the flutes 24 to the scrim 26. Preferably, however, the flutes 24 are attached to the scrim 26 by placing four individual flutes 24 upon a length of plywood such that the flutes 24 are in phase trough to trough and peak to peak and are spaced about two inches from one another. The flutes are then temporarily secured or held in place on the plywood utilizing, for example, a plurality of finishing nails strategically placed to hold the flutes on edge, as is depicted in FIG. 3, for example. Preferably, multiple flutes 24 are connected end-to-end to form a length of about 40 feet. The flutes may be connected utilizing, for example, conventional staples 41. The scrim 26 is then laid on top of the flutes 24 and pulled tight against the flutes 24. Preferably, the scrim 26 overlaps the two outermost flutes 24 by approximately one-half inch. A toothpaste-like bead of thixotropic resin 28 is then applied to the scrim 26 where the scrim 26 contacts the flutes 24. The thixotropic resin 28 may be produced by adding a filler to a conventional resin. A filler suitable for use in producing thixotropic resin 28 is a filler sold under the trademark AEROSIL 200 by Degussa Corp. of Teterboro, N.J. To ensure a good bond between the thixotropic resin 28, scrim 26, and flutes 24, preferably the bead of thixotropic resin 28 is flattened utilizing, for example, a finger protected by a rubber glove, a roller, etc. This method of construction results in a core 19 about nine inches wide and about one inch thick. As above, such dimensions and materials are preferred but are exemplary.

After the thixotropic resin 28 has hardened, the flutes 24 and scrim 26 which collectively form core 19 are wound upon a spool. Multiple lengths of the core 19 may be attached by stapling end-to-end to create a large continuous roll of core 19.

Tank halves 11 and 12 are individually produced upon a rotatable mandrel having a configuration approximately like that of the inside of the tank halves 11 and 12. Such mandrels are conventional, and one example would be a mandrel that has a generally cylindrical outer surface area that is expandable and contractible in diameter and, thus, effective circumference. Using such a mandrel, a tank half could be made while the mandrel is in expanded condition and the finished tank half subsequently could be removed from the mandrel after the mandrel is contracted to reduced diameter.

The first step in producing tank halves 11 and 12 is to form the inner wall 17. Inner wall 17 is produced by expanding the mandrel and coating it with mylar to facilitate subsequent release. Utilizing a chopping gun a mixture of chopped fiberglass strands and resin is applied to the mylar coated mandrel. Preferably, the mixture comprises about 70 percent by weight resin. To facilitate the manufacturing process described herein, the mandrel may be rotated continuously about the central axis thereof as conventional spraying equipment is used to spply, e.g. by spraying, materials onto the mandrel to form respective layers, etc. In the preferred embodiment three layers of chopped fiberglass are applied to the mandrel, and then a layer of 24-ounce fiberglass woven roving is applied to the mandrel. Then, preferably about two more layers of the mixture of chopped fiberglass and resin are applied. Preferably, these multiple layers form a thickness of about one-quarter inch.

Figure 6:
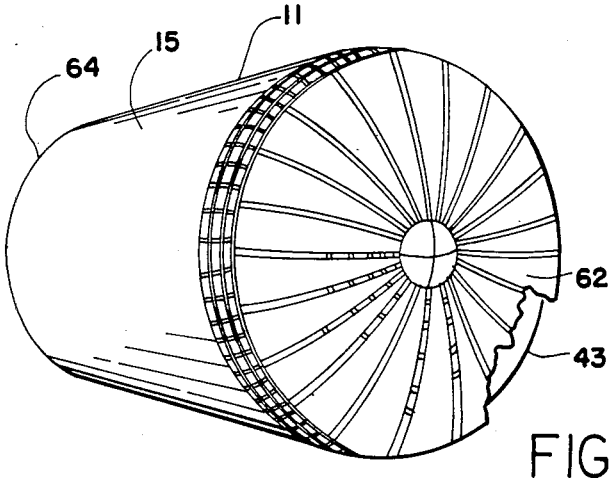
FIG. 6 is a perspective view of one of the tank halves of the tank of FIG. 1 prior to the formation of the outer end cap.

End wall 14 is constructed by first producing an inner cap 43, as is illustrated in FIG. 6, after the inner wall 17 has been produced. Inner end cap 43 is formed by coating the end of mandrel with multiple layers of roving and the mixture of chopped fiberglass and resin as discussed above in connection with the inner wall 17. More specifically, inner end cap 43 is produced preferably by applying to the end of the mandrel three layers of the mixture of chopped fiberglass and resin, a layer of roving, two more layers of the mixture, another layer of roving, and one more layer of the mixture. Preferably, these multiple layers form an inner end cap 43 having a thickness of about $\frac{3}{8}$ of an inch.

The resin utilized in forming the inner wall 17 and inner end cap 43 may comprise one that is resistant to degradation when placed in contact with either methanol or ethanol. The utilization of such a chemically resistant resin renders the tank 10 suitable for use in storing methanol or ethanol. Specifically, approximately the inside $\frac{1}{8}$ inch of the inner wall 17 and inner end cap 43 may be produced using such chemically resistant resin. An example of a resin which is resistant to methanol and ethanol and is suitable for use with the present invention is an epoxy base resin sold under the trademark ATLAC 570 by Koppers Company Inc., of Pittsburgh, Penn. Beyond the first $\frac{1}{8}$ inch of thickness, the inner wall 17 and inner end cap 43 may be produced utilizing, for example, the above mentioned ATLAC 400 resin. It will be appreciated that in addition to utilizing a resin which is chemically resistant to ethanol or methanol, additional resins which are chemically resistant to other material such as, for example, acids, may be utilized in a like manner as the ATLAC 570 to produce a tank which is capable of storing such other materials.

Preferably, a catalyst is added to the resins to promote the hardening thereof. A preferred catalyst is methyl ethyl ketone peroxide which may be added to the resin at a rate of 1.5 to 2 percent by weight. This addition rate results in approximately a 40-minute cure time. In order to facilitate the application of the core 19, however, the addition rate of catalyst during the last application of the mixture of chopped fiberglass and resin to the inner wall 17 is preferably dropped to about one percent by weight so as to provide approximately a one-hour cure time. Additionally, in the last layer of the inner wall 17, preferably the mixture of chopped fiberglass and resin comprises about 80 percent by weight resin.

The core 19 is applied to the outer surface 21 of the inner wall 17 before the resin in the mixture on the outer surface 21 has cured. The ability to apply the core 19 to the outer surface 21 before the outer surface 21 has cured allows the tank 10 to be built on a continuous basis thereby reducing manufacturing costs and maximizing capital equipment utilization. The core 19 is applied to the outer surface 21 preferably in a "spiral", "helical" or "barber pole" fashion with the scrim 26 forming the outermost surface. The core 19 is applied by feeding a four flute strip thereof onto the rotating mandrel, whereby upon successive 360 degree rotations of the mandrel result in side-by-side strip-like revolutions of the core about the mandrel. Only a minor overlap need be provided between successive revolutions of core 19. To facilitate such spiral application, the width of the core 19 is angularly sliced for a length equal approximately to one revolution of the mandrel or the circumference of the inner wall 17. Specifically, if for example, the inner wall 17 has a circumference of 25 feet and the width of the core 19 is nine inches, the first 25 feet of core 19 would be cut on a taper, from 0 to 9 inches. It will be appreciated that the core 19 displays such flexibility that perfect tracking is not required when wrapping the core 19 around the inner wall 17.

The leading edge of the core 19 is secured by first wrapping a fiberglass filament strand several times around the inner wall 17. Such wrapping causes the strand firmly to secure itself to the inner wall 17 and to prevent the strand from slipping when pulled. The free end of the strand is then attached to the core 19. Attachment may be facilitated, for example, by drilling a hole in the end of one of the flutes 24 of the core 19 and threading the strand through the hole and tying it securely to the flute 24. Upon tying, the strand serves to prevent the core 19 from slipping or moving as the core 19 is tightly wrapped around the inner wall 17.

Care must be exercised to wrap the core 19 tightly so that the edges of the flutes 24 become firmly embedded within the outer surface 21 of the inner wall 17. Preferably, approximately 40 pounds per square foot of pressure should be applied to the core 19 and a meniscus of resin indicated at 22 should form upon the edges of the flutes 24 in contact with the outer surface 21. After the core 19 is wrapped around the entire outer surface 21 of the inner wall 17, the end of the core 19 is trimmed to provide a straight edge at the end of side wall 15. Alternatively, in order to conserve the use of core 19, the angularly sliced piece initially cut from the core 19 could be used on the last wrap to provide a straight edge.

Upon completion of the wrapping of the core 19 the exposed scrim 26 is then sprayed lightly with resin. A continuous glass filament strand 52 then may be wrapped around the core 19 further to compress the core 19 into the outer surface 21 of inner wall 17. Preferably, such filament strand is about one-half inch wide and each revolution of the strand is spaced about four inches.

The first layer of the outer wall 18 is then applied over the scrim 26 of the core 19 and the continuous glass filament strand 52. This first layer may be formed of the same mixture of chopped fiberglass and resin as discussed above in connection with the inner wall 17 and the inner end cap 43. Preferably, the resin in the first layer of the mixture of resin and fiberglass will significantly penetrate the underlying layer of scrim 26 and filament strand 52. Such penetration ensures a secure bond between the core 19 and the outer wall 18 thereby enhancing the structural integrity of tank 10.

Consecutive layers of the fiberglass roving and the mixture of chopped fiberglass and resin as described above in connection with the inner wall 17 are applied to form the outer wall 18 having a thickness of about one-quarter inch.

Figure 7:
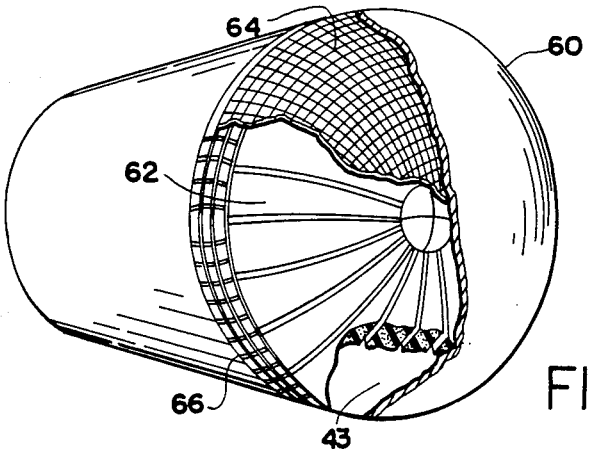
FIG. 7 is a perspective end view of one of the tank halves of the tank of FIG. 1 with the outer end cap, scrim and foam board partially broken away.
Figure 8:
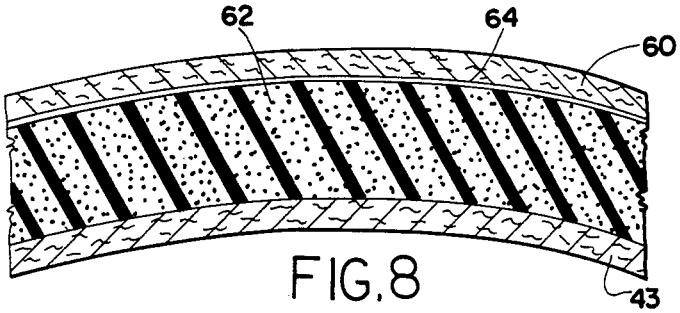
FIG. 8 is a fragmentary cross-sectional view of one of the end walls of the tank of FIG. 1.

Upon completion of the outer wall 18 the outer end cap 60 as illustrated in FIGS. 7 and 8 is formed. Outer end cap 60 is formed by first attaching multiple pieces of isocyanurate foam board 62 to the inner end cap 43. Foam board 62 serves as a base for constructing outer end cap 60 and it provides multiple air gaps between the inner end cap 43 and outer end cap 60 much like core 19 provides air gaps between inner wall 17 and outer wall 18. Preferably, foam board 62 is about one inch thick, closed cell, having about a 1.9 pound per cubic foot density and about a 20 pound per square foot compressive strength. Preferably, the foam board 62 is attached to the inner end cap 43 while the resin in the outer layer of the inner end cap 43 is still uncured. Also, preferably a putty-like mixture comprising resin, AEROSIL 200, and chopped fiberglass is applied to the side of the foam board in contact with the inner end cap 43 to promote maximum adhesion. The putty-like mixture preferably comprises about ten percent by weight chopped fiberglass and about ten percent by weight AEROSIL 200.

Lengths of scrim 64, like that used in core 19, are then stretched over the foam boards 62 and the ends of the scrim 26 are then stapled to the outer pieces 66 of foam board abutting outer wall 18 of side wall 15. Scrim 64 serves as a base for building outer end cap 60. Outer end cap 60 is produced in the same manner as inner end cap 43 by applying multiple layers of roving and the mixture of chopped fiberglass and resin to the same thickness of about $\frac{3}{8}$ of an inch.

Upon completion of the outer end cap 60, the mandrel is collapsed and the tank half, say half 11, is stripped from the mandrel. Upon stripping tank half 11 is open at end 64. A similar tank half 12 is then produced, for example, as was described above with respect to tank half 11. Tank half 12 also has an open end like tank half 11. Tank 10 is produced by abutting the open ends 64 of a pair of tank halves 11 and 12 and forming the connecting joint 13 in the same manner that conventional twin wall or single wall fiberglass tank halves are connected. More specifically, multiple layers of resin soaked fiberglass mat and a mixture of chopped fiberglass and resin are applied upon inner wall 17 from the inside of tank 10 in the immediate proximity of the abutment of the tank halves 11 and 12 and upon the outer wall 18 from the outside of tank 10 in the same general location.

It will be appreciated that instead of connecting a pair of tank halves 11 and 12 to form a tank 10, a tank may be produced in accordance with the present invention, for example, by attaching a pair of prefabricated fiberglass end caps to the open end of the tank half to close the open end. Similarly, it will be appreciated that tank halves 11 and 12 could be constructed with no end walls 14, and utilized, for example, as twin wall piping.

Also, it will be appreciated that in addition to producing a tank 10 having, for example, inner wall 17 and outer wall 18 thicknesses of about one-quarter inch, and inner end cap 43 and outer end cap 60 thicknesses of $\frac{3}{8}$ of an inch, a tank made in accordance with the present invention may have any one of a variety of structural dimensions. The appropriate structural dimensions will be a function of the tank's application. More particularly, the dimensions of the tank will be a function of, for example, the desired capacity of the tank, whether the tank is to be employed above or below ground, the weight of the material being stored in the tank, and other like considerations. Additionally, the walls 17 and 18, and caps 43 and 60, may be produced utilizing any number or sequence of layers of roving and the mixture of chopped fiberglass and resin, the present invention contemplating all such variations and in no way being limited to the examples set forth above.

Figure 11:
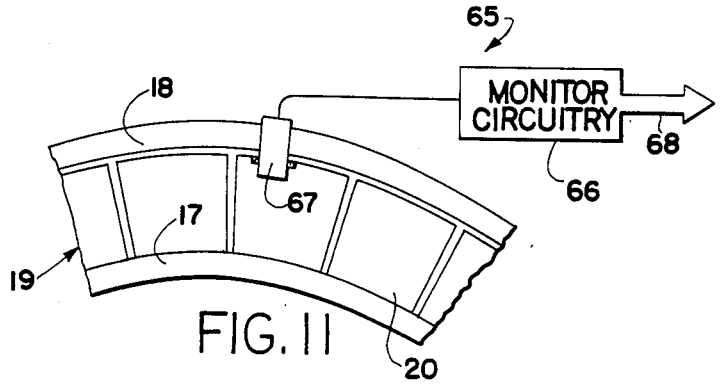
FIG. 11 is a schematic of a monitoring system for use in conjunction with a twin wall fiberglass tank made in accordance with the present invention.

Referring now to FIG. 11 there is schematically illustrated a monitor system 65 which may be used to detect leaks in twin wall tanks made in accordance with the present invention. Monitor system 65 includes a monitor circuit 66 and sensor 67. Sensor 67 is placed, for example, in air gap 20 formed by core 19.

The monitor circuit 66 receives electrical input from and possibly also may energize the sensor 67. The sensor 67 may be a conventional sensor that senses or detects a leak condition in one of the walls 17 and 18 of tank 10, for example, by detecting differentials in pressure or the absolute presence of liquid in the air gap 20 formed between the walls. Such air gap 20 is interconnected generally throughout each tank half 11 and 12 due to the core 19 arrangement. The monitor circuitry 66 may be conventional, for example, including an amplifier, level sensing and/or other circuits to provide an output 68, an electrical signal, or other signal bearing information indicating whether or not a leak has been sensed by the sensor 67. Such information may be used by further apparatus to indicate an alarm or fault condition requiring checking. Each tank half, 11 and 12, may have a separate monitor system 65, and, if desired, multiple monitoring systems.

It will further be appreciated that in addition to producing a cylindrical tank 10, the teachings of the present invention may easily be adapted to producing tanks of various configurations including, for example, spherical tanks. Additionally, it will be appreciated that the present invention may be used to produce any twin wall fiberglass structure having a curved surface. Such structures include, for example, domes, arches, aboveground tank walls, twin wall pipe, or the like.

Figure 9:
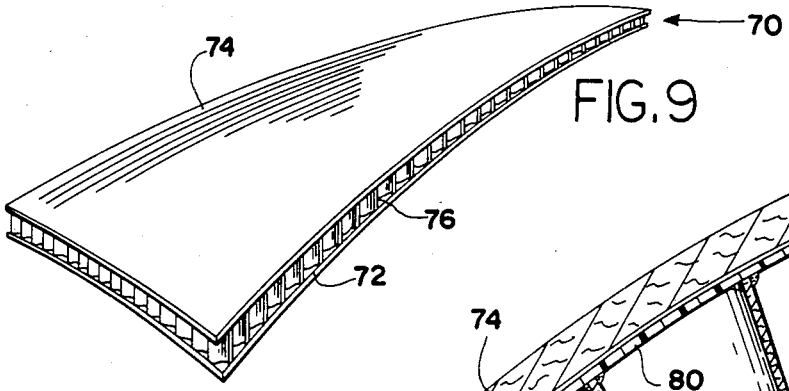
FIG. 9 is a perspective view of a dome building panel made in accordance with the present invention.
Figure 10:
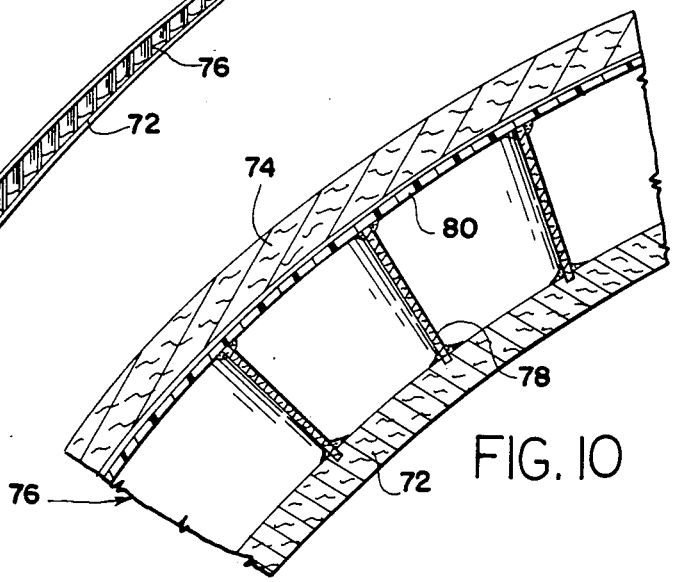
FIG. 10 is a fragmentary cross-sectional view of the dome building panel of FIG. 9.

Referring now to FIGS. 9 and 10 there is illustrated a dome section 70 made in accordance with the present invention. Specifically, like the side walls of tank 10, the section 70 includes an inner wall 72, an outer wall 74, and a core 76. Inner wall 72 and outer wall 74 are constructed of multiple layers of fiberglass roving and a mixture of chopped fiberglass and resin in a similar manner as discussed above in connection with inner wall 17 and outer wall 18. Core 76 is constructed in the same manner as core 18 discussed above and it includes flutes 78 and scrim 80. Core 76 is applied to the inner wall 72 before the inner wall 72 has cured and the outer wall 74 is then constructed upon the core 76. Multiple dome sections 70 may be prefabricated off location and assembled on-site, to form, for example, a dome or similar structure.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the following claims.

What is claimed is:

1. A multiple wall fiberglass tank structure, comprising an inner fiberglass wall, an outer fiberglass wall, a preformed core separating said inner wall and said outer wall, said core including plural elongate, fluted, strip-like, relatively rigid fiberglass members having opposite lateral edges and a flexible, permeable fabric-like mounting means initially attached to a lateral edge of a plurality of said members for effecting generally parallel relative spacing of said plurality of strip-like members, said members being bonded to said inner wall and to said outer wall, said mounting means comprising permeable material for permitting penetration of resin therethrough during formation of said outer wall to bond said outer wall to said members, and said mounting means being impregnated with resin to form at least a portion of said outer wall.

2. The structure of claim 1, wherein said members are sinusoidal shape.

3. The structure of claim 1, wherein said members are aligned in parallel with one another.

4. The structure of claim 1, wherein said walls comprise chopped fiberglass and resin.

5. The structure of claim 1, wherein said inner wall and said outer wall each comprise multiple layers of fiberglass roving and a mixture comprising chopped fiberglass and resin.

6. The structure of claim 1, further including an end wall comprising an inner end cap and an outer end cap.

7. The structure of claim 1, wherein said end wall further includes foam boards disposed between said inner end cap and said outer end cap.

8. The structure of claim 1, wherein said foam boards comprise isocyanurate foam boards.

9. The structure of claim 1, comprising a pair of tank halves.

10. The structure of claim 1, further including monitor means for detecting a leak in said inner wall and/or said outer wall.

11. The structure of claim 1, wherein said mounting means comprises woven glass fabric.

12. The structure of claim 11, said members comprising sinusoidal shape flutes.

13. The structure of claim 12, wherein said flutes are aligned in parallel with one another.

14. The structure of claim 1, said inner wall comprising a resin material, one lateral edge of said members being embedded in said resin.

15. The structure of claim 14, said resin forming a meniscus with said one lateral edge thereby to effect a secure bond between said members and said inner wall.

16. The structure of claim 1, said mounting means being incorporated as part of said outer wall.

17. The structure of claim 1, said mounting means comprising fiberglass.

18. The structure of claim 1, said tank structure having a generally cylindrical shape with a longitudinal axis, said inner and outer walls surrounding an interior volume of the tank, and said members being oriented generally in transverse relation about the axis of the tank.

19. The structure of claim 18, further comprising an end wall at each end of said inner and outer wall for closing the ends of the tank structure.

20. The structure of claim 1, further comprising monitor means for monitoring the integrity of said walls by detection of fluid between said walls.

21. The structure of claim 1, said strip-like members comprising resin impregnated fiberglass, said mounting means comprising a scrim material.

22. The structure of claim 21, said scrim material comprising fiberglass material.

* * * * *